US005645792A

United States Patent [19]

Forte et al.

[11] Patent Number: 5,645,792

[45] Date of Patent: Jul. 8, 1997

[54] SLAG CONTROL SHAPE RELEASE APPARATUS FOR MOLTEN METAL VESSELS

[75] Inventors: Gary L. Forte, Northville; David B. Vinson, Redford, both of Mich.; Thomas Connors, Dyer, Ind.

[73] Assignee: AJF, Inc., Plymoutn, Mi

[21] Appl. No.: 586,967

[22] Filed: Jan. 16, 1996

[51] Int. Cl.[6] ..... B22D 41/14

[52] U.S. Cl. ..... 266/230; 266/227

[58] Field of Search ..... 266/230, 227, 266/272, 271, 45; 222/594, 597, 591, 590

[56] References Cited

U.S. PATENT DOCUMENTS

| | | | |
|---|---|---|---|
| 11,676 | 9/1854 | Morris | 73/323 |
| 1,815,361 | 7/1931 | Morris et al. | 266/227 |
| 2,295,932 | 9/1942 | Campbell et al. | 254/173 |
| 3,262,691 | 7/1966 | Vanderbeck | 266/230 |
| 3,459,209 | 8/1969 | Kobusch et al. | 222/597 |
| 4,431,169 | 2/1984 | Fuzii et al. | 266/236 |
| 4,468,013 | 8/1984 | LaBate | 266/272 |
| 4,526,349 | 7/1985 | Schwer | 266/45 |
| 4,553,743 | 11/1985 | LaBate, II et al. | 266/272 |
| 4,610,436 | 9/1986 | LaBate, II et al. | 266/272 |
| 4,637,592 | 1/1987 | LaBate, II et al. | 266/272 |
| 4,640,498 | 2/1987 | LaBate et al. | 266/272 |
| 4,922,994 | 5/1990 | Ogura et al. | 266/230 |
| 4,968,007 | 11/1990 | Forte et al. | 266/230 |
| 5,249,780 | 10/1993 | Forte et al. | 266/230 |
| 5,303,902 | 4/1994 | Forte et al. | 266/230 |
| 5,421,560 | 6/1995 | Forte et al. | 266/230 |
| 5,423,522 | 6/1995 | Forte et al. | 266/230 |

FOREIGN PATENT DOCUMENTS

| | | |
|---|---|---|
| 0249573 | 12/1987 | European Pat. Off. . |
| 2814699 | 1/1980 | Germany . |
| 57-171568 | 10/1982 | Japan . |
| 62-203667 | 9/1987 | Japan . |
| 0175142 | 8/1989 | Japan . |
| 0517542 | 1/1972 | Switzerland . |
| 0517542 | 2/1972 | Switzerland . |

*Primary Examiner*—Scott Kastler
*Attorney, Agent, or Firm*—Young & Basile, PC.

[57] ABSTRACT

A slag control shape is releasably mounted on a mounting member carried on a cover of a molten metal vessel. A movable member is carried on the cover and moved by an actuator into engagement with and moving the mounting member to move the mounting member to a position releasing the slag control shape for insertion into the molten metal vessel. The actuator is a fluid operated cylinder having an extensible piston rod which is engageable with the movable member to move the movable member into engagement with the mounting member. A valve actuated remotely from the cover supplies pressurized fluid to the cylinder to extend the piston rod. Alignment sensors are mounted on the cover and an actuator support to ensure that the cover is rotatably positioned on the molten metal vessel to align the actuator and movable members.

12 Claims, 3 Drawing Sheets

SLAG CONTROL SHAPE RELEASE APPARATUS FOR MOLTEN METAL VESSELS

BACKGROUND OF THE INVENTION

1. Field of the Invention

The present invention relates, in general, to metal making apparatus and, specifically, to molten metal receptacles and, more specifically, to slag control shapes used in molten metal vessels.

2. Description of the Art:

In metal making processes, such as steel making, molten metal is transferred from a furnace or converter by a ladle to a tundish or directly to a casting machine. In all metal making processes, and, in particular, in steel making processes, a layer of slag containing metal impurities forms above the top surface of the molten metal within the ladle and the tundish. When the molten metal is discharged from the ladle or tundish, it is necessary to maintain a separation between the slag and the molten metal so that high quality steel without significant amounts of slag can be produced.

The slag forms a layer of impurities several inches thick on top of the layer of molten metal in the ladle and in the tundish. In addition, the flow of molten metal through the discharge nozzle in the ladle or tundish creates a vortex which introduces a conically-shaped rotation to the molten metal immediately above the discharge nozzle. When a sufficient quantity of molten metal is maintained within the ladle or tundish, the vortex forms completely within the molten metal layer and does not reach to the slag layer atop the molten metal layer. However, when the level of molten metal within the ladle or tundish drops below the predetermined critical depth, the vortex reaches into the slag layer and draws slag through the center of the vortex to the discharge nozzle along with molten metal. This causes the introduction of slag into the molten metal as it is discharged from the ladle or the tundish and results in steel having less than desirable quantities as well as creating a potentially hazardous situation.

In order to prevent the introduction of slag into the molten metal, various slag control shapes, such as balls, frusto-conical bodies, etc., as shown in U.S. Pat. Nos. 4,725,045 and 4,968,007, are introduced into the transfer ladle or tundish. Such slag control shapes or bodies have a predetermined specific gravity less than the specific gravity of the molten metal and greater than the specific gravity of the slag layer so that the slag control shape or body is buoyantly supported at the interface between the slag layer and the molten metal layer. Such slag control bodies or shapes are also designed to locate and center themselves automatically in the vortex formed above the discharge nozzle from the molten metal vessel or receptacle. The lower portion of such slag control bodies is disposed in the molten metal layer and will enter and seat within the upper portion of the discharge nozzle of the molten metal receptacle when the molten metal layer drops below a predetermined depth so as to block the discharge nozzle and prevent the discharge of slag from the receptacle.

While such slag control bodies or shapes have found widespread use and effectively block the undesirable discharge of slag from a molten metal vessel, such as a transfer ladle or tundish, the introduction of such slag control bodies into the molten metal receptacle has proved to be a problem.

Typically, such slag control bodies are introduced into the transfer ladle or tundish at a predetermined time during the discharge of molten metal from the ladle or tundish. The time of insertion of the slag control body is based on an operator's experience, typically on the total time of molten metal discharge, or on a potentially inaccurate vessel or ladle weight reading from a load cell in a ladle weight system. As ladles positioned in caster turret arms are typically 20 feet or more in height, overhead cranes have been used to drop the slag control body into the ladle at the point in time indicated by an operator. However, such cranes are assigned numerous other tasks which make it difficult to insure that a crane is available at the precise time that the operator determines it necessary to insert the slag control body into the molten metal vessel.

A small number of metal making or casting machine installations have a stairway located adjacent the discharge position of a ladle which enables a worker, such as a ladleman, to climb to the top of the ladle and insert the slag control body into the ladle at the required time. However, the height of the ladle, the approximate 25 pounds or more weight of the slag control body, and the high temperatures involved in the molten metal process make such a task difficult, undesirable and dangerous. Further, the ladleman typically has other duties in monitoring the metal making process which must be neglected for the time it takes to climb the stairs and insert the slag control body. Dedicating one person solely to the task of inserting the slag control body into the molten metal vessel at the required time adds costs to the metal making process as such an individual is only required is to perform his single task at widely spaced, intermittent intervals.

Further, when such slag control shapes are dropped into a molten metal vessel, they typically fall from 10 to 15 feet before hitting the slag layer. Due to the buoyancy characteristics of a slag control shape and its momentum during dropping into the vessel, the slag control shape will initially pass through the slag layer and into the molten metal and then bob up out of the molten metal and slag until it settles at the molten metal/slag interface. However, this bobbing force and the inherent buoyancy characteristics of a slag control shape frequently cause the slag control shape to settle at a position away from a desired position directed above the discharge outlet of the molten metal vessel. Indeed, it is infrequent for the slag control shape to settle directly over the discharge outlet since the discharge outlet is typically 2½ to 4½ inches in diameter as compared to the 10 to 20 foot diameter of a typical ladle. Thus, when a vortex begins to form above the discharge outlet when the molten metal reaches a low level within the ladle or vessel, the slag control shape may not be able to reach the vortex in time to serve its function of blocking the outlet to prevent the discharge of slag through the outlet. Furthermore, even if the slag control shape initially settles directly over the discharge outlet, it frequently drifts away since a vortex may not have formed above the outlet and never returns to the desired centered position thereby defeating its intended purpose.

In order to address these problems, one of Applicants' previously devised a slag control shape release apparatus which is disclosed in U.S. Pat. No. 5,249,780 issued on Oct. 5, 1993. In this apparatus, the hanger of a slag control shape extends through a bore in a molten metal vessel cover and, also, through a bore in a lid pivotally mounted on the cover. A pin is mounted on the lid and biased to a position extending through the hanger to support the slag control shape on the cover. An actuating cable is connected to the pin and extends from the cover to an easily accessible position for remote actuation of the release mechanism to release the pin from the slag control shape and to allow the descent of the slag control shape into the molten metal vessel.

A similar release apparatus has also been devised by one of the Applicants and is disclosed in U.S. Pat. No. 5,303,902 issued on Apr. 19, 1994. In this apparatus, a mounting means including a reciprocally movable pin is mounted on a frame pivotally mounted on the cover of a molten metal vessel and is actuated by a cable extending from the pin to a free end remote from the cover. A cable wound around a reel mounted on the frame is attached to the slag control shape to control the descent of the slag control shape into the molten metal vessel after release from the pin.

Yet another release apparatus has been devised by one of the Applicants' and is disclosed in U.S. Pat. No. 5,423,522, which issued on Jun. 13, 1995. In this release apparatus, a lid is removably implacable in a bore in the cover. The hanger or rod of a slag control shape extends through the lid and is releasably received in mounting means on the lid. The actuating means is similar to that in the other release devices devised by the Applicants' in that it is in the form of a cable having an end operable from a location remote from the cover on the molten metal receptacle. In this latter design, means are provided for releasably connecting the actuating means to the mounting means after the mounting means and the lid have been mounted on the cover. This enables the heavy mounting and activating means to be mounted on the lid rather than on the cover which is typically formed of lightweight refractory or ceramic fiber materials.

In the slag control apparatus, also devised by one of the Applicants, and shown in U.S. Pat. No. 5,421,560, issued on Jun. 6, 1995, the mounting means of the slag control shape release apparatus includes a frame fixedly mounted on a lid and slidably supporting a tubular pin. The pin supports the hanger of the slag control shape at one end. A biasing means mounted on the frame normally biases the pin to a first position. The actuating means is releasably connected to the mounting means for actuating the mounting means to release the slag control shape. The actuating means is also operable from a location remote from the cover. In one embodiment, a weight control means determines the weight of the ladle indicate the amount of molten metal remaining in the receptacle. At an appropriate preset weight, a controller transmits a radio frequency signal to the actuating means to automatically release the slag control shape into the molten metal receptacle.

While all of these apparatus have proved effective at accurately dropping a slag control shape into a molten metal vessel and permitting the timely release of the slag control shape from an easily accessible location remote from the cover on top of a molten metal vessel, all except the latter release apparatus require the manual intervention of the ladleman or operator at the proper time to pull the cable to release the slag control shape from the cover. Despite the close location of the end of the cable connected to the actuating means in each of these release devices to the operator, the operator is still required to move at least a short distance to grasp and pull the cable. Thus, it would be desirable to provide a slag control shape release apparatus for use with a molten metal receptacle or vessel which enables an operator to release a slag control shape into the receptacle from a location more convenient or closer to the usual location of the operator or ladleman on the casting platform adjacent to the ladle.

SUMMARY OF THE INVENTION

The present invention is a slag control shape release apparatus for a molten metal vessel or receptacle having an open top end closed by a removable cover. The release apparatus includes means, mountable on the cover, for releasably mounting a slag control shape on the cover, the mounting means moveable between a first position releasably mounting a slag control shape on the cover and a second position releasing the slag control shape for descent into the molten metal vessel; means, mounted on the cover and engageable with the mounting means, for moving the mounting means from the first to the second position; and means, separate from the cover and engageable with the moving means, for actuating the moving means to move the mounting means from the first position, the actuating position being operable from a position remote from the cover.

Preferably, the mounting means is in the form of a mounting member pivotally mounted on the cover and releasably engageable with a slag control shape mounted to a bore extending through the cover. The mounting member has an exemplary hook-shape with first and second opposed ends. The hook member is pivotally mounted on the cover intermediate the first and second ends. Means are provided for normally biasing the mounting member to the first position for mounting the slag control shape on the cover.

The moving means preferably comprises a push rod movably mounted on the cover and having first and second opposed ends. The first end is engageable with the mounting means when the push rod is advanced to a second position. The second end is engaged by the actuating means. Support members are mounted on the cover for slidably supporting the push rod on the cover.

The actuating means preferably comprises a fluid operable cylinder having an extensible and retractable piston rod mounted therein, with an end of the piston rod extending exteriorly of the cylinder. The end of the piston rod is engageable with the mounting means when the piston rod is in an extended position. Valve means are coupled to the fluid operable cylinder for selectively supplying pressurized fluid to the cylinder to extend the piston rod. Operating means, located remote from the cylinder, are provided for actuating the valve means to supply the pressurized fluid to the cylinder.

The slag control shape release apparatus of the present invention further includes means for determining alignment of the actuating means and the moving means when the cover is disposed on the molten metal receptacle. The aligning means, in an exemplary embodiment, comprises a light emitter and light reflector pair which are mounted on or adjacent to the actuating means and on the cover of the molten metal vessel. The aligning means generates an output signal when the actuating means is aligned with the moving means.

The slag control shape release apparatus of the present invention provides an easily operable means for automatic insertion of a slag control shape into a molten metal vessel. The present slag control shape release apparatus is operable from a location in close proximity to an operator or ladleman positioned adjacent to the molten metal vessel. In this manner, the release apparatus may be actuated to insert the slag control shape into the molten metal vessel without requiring substantial movement of the operator to the valve operator. Finally, the slag control shape release apparatus of the present invention is constructed of a minimal number of components for a low cost and long term reliable operation.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is an apparatus which automatically inserts a slag control shape into a molten metal receptacle or vessel, such as a transfer ladle or tundish, at an appropriate time as determined by an operator or ladleman.

Figure 1:
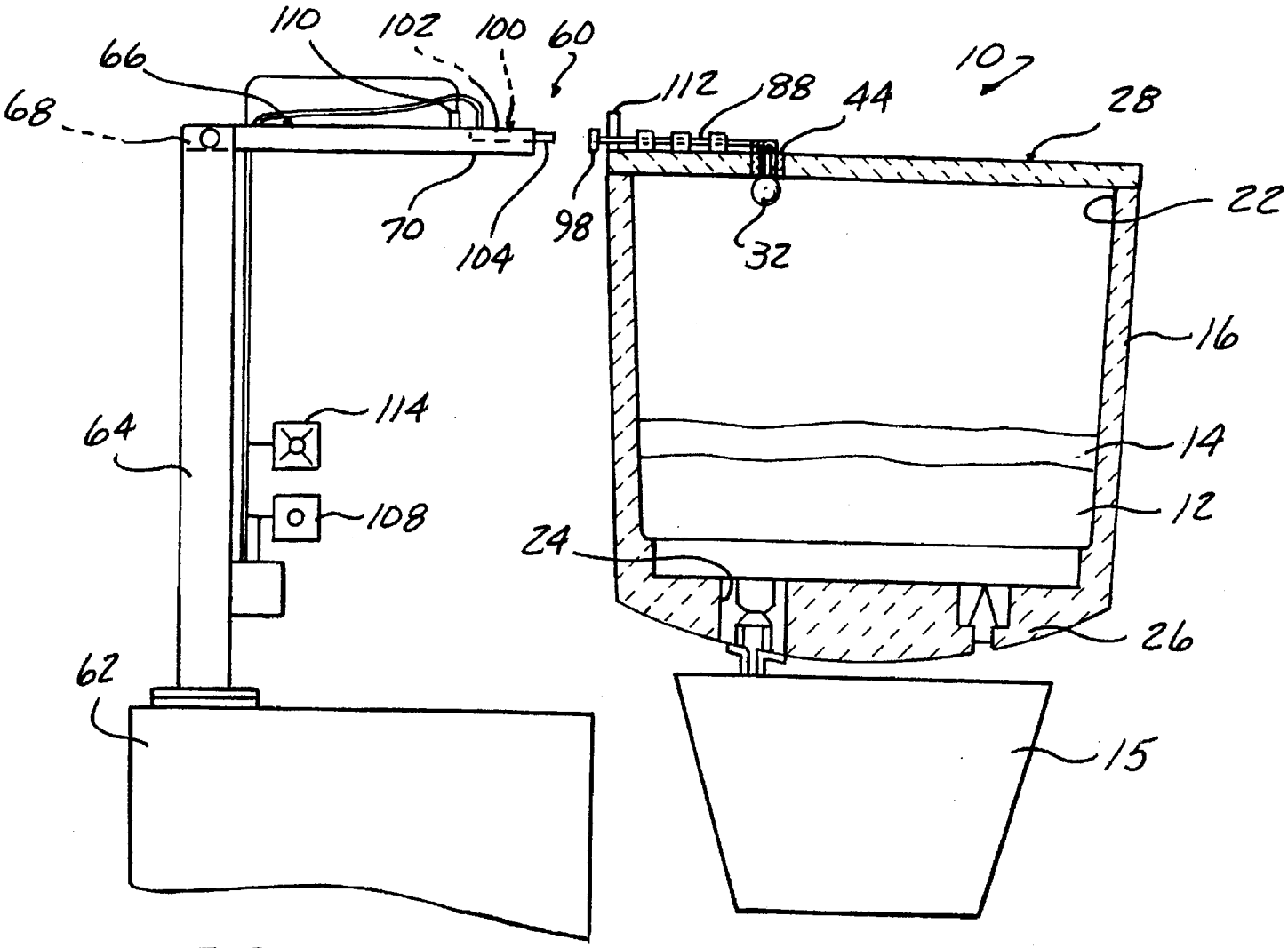
FIG. 1 is a partially cross sectioned, side elevational view of a molten metal receptacle employing a slag control shape release apparatus according to the present invention.

As shown in FIG. 1, a molten metal receptacle 10 is provided for containing a layer of molten metal 12, such as steel, etc. As is conventional, a layer of slag 14 forms on the top of the layer of molten metal 12 within the vessel 10. Although the molten metal vessel 10 is illustrated as being in the form of a transfer ladle used to transfer molten metal from a tapping converter or furnace to a tundish 15 or casting machine, it will be understood that the slag control shape release apparatus of the present invention may also be employed with other types of molten metal vessels, such as tundishes, etc.

By way of background, the molten metal vessel or ladle 10 includes outer, side walls 16 typically formed of a metallic outer shell and an inner layer formed of a refractory material, such as firebrick, etc. An open top end 22 is formed on the ladle 10. A discharge nozzle or outlet 24 is formed in a bottom wall 26 of the ladle 10 and provides an outlet path for molten metal from the ladle 10 to a tundish 15, casting machine, etc.

A cover 28 having a generally circular shape is formed of a refractory material and is removably inserted over the open top end 22 of the ladle 10 to close off the interior of the ladle 10 in order to retain heat within the molten metal 12 in the ladle 10. The cover 28 is mounted on and removed from the ladle 10 by means of a crane which engages a hook, not shown, mounted on the cover 10.

Figure 2:
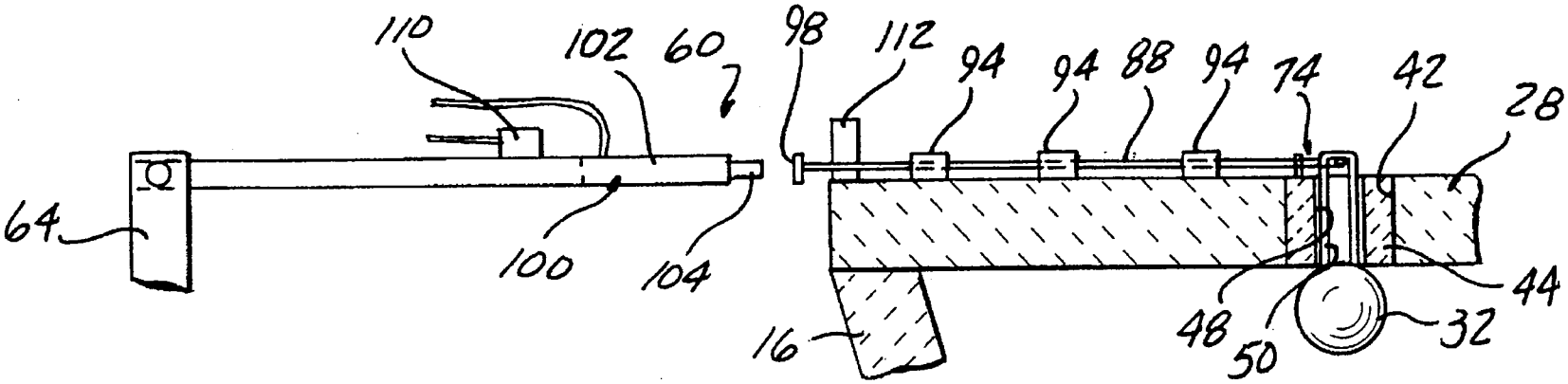
FIG. 2 is a partially cross sectioned, enlarged side elevational view of the slag control shape release apparatus shown in FIG. 1.

As is conventional, a slag control shape or body denoted generally by reference number 32 in FIGS. 1 and 2, is employed to prevent the discharge of slag 14 through the discharge nozzle 24 when the layer 12 of molten metal reaches a predetermined low depth. The slag control shape or body 32 may have any predetermined size and shape, such as that disclosed in U.S. Pat. No. 4,968,007 or the plug shown in U.S. Pat. No. 4,725,045. The contents of U.S. Pat. No. 4,968,007, with regard to the description and use of the slag control body, are incorporated herein by reference. Generally, however, such slag control shapes or bodies 32 are formed of a suitable refractory material having a specific gravity less than the specific gravity of the molten metal 12, but higher than the specific gravity of the slag 14. In this manner, the slag control shape or body 32 buoyantly floats at the interface 34 formed between the layer of molten metal 12 and the slag layer 14. When the layer of molten metal 12 reaches a predetermined low level, the lower portion of slag control body 32 will first prevent the vortex action from occurring and, as draining is completed, will engage the discharge nozzle 24 in the ladle 10 and thereby block the further discharge of molten metal and, more importantly, the discharge of slag 14 from the ladle 10.

Figure 3:
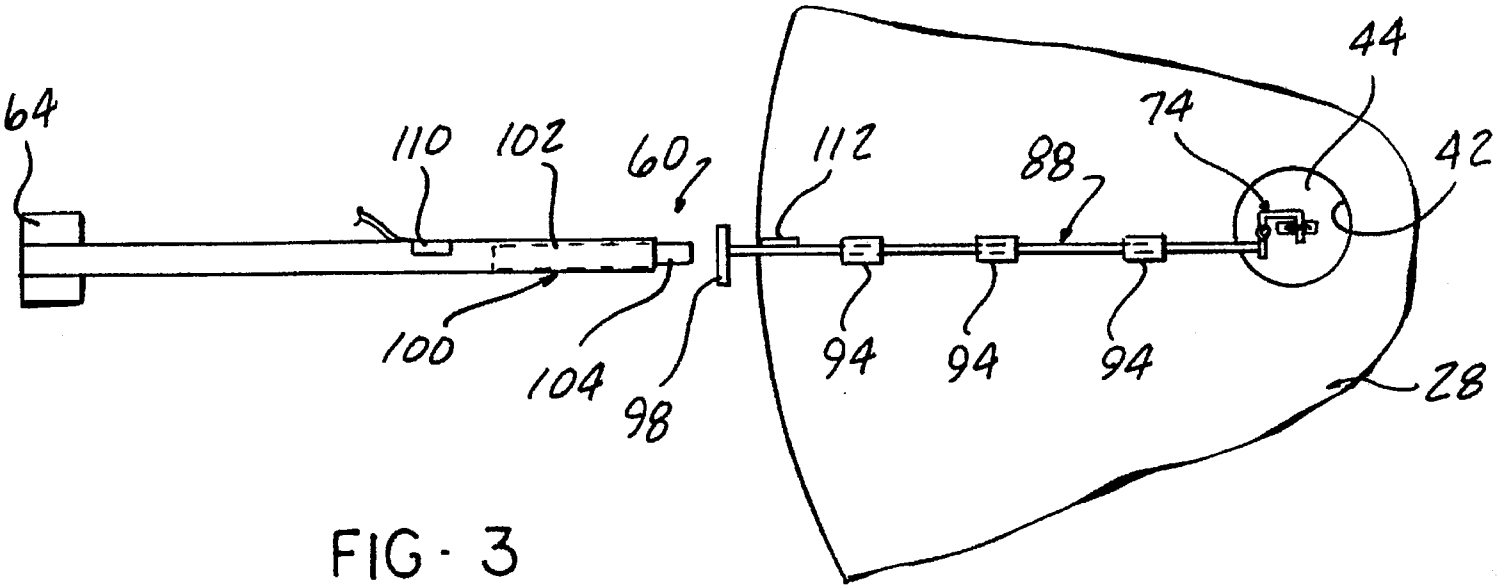
FIG. 3 is a plan view of the slag control shape release apparatus shown in FIG. 2.

In one embodiment shown in FIGS. 1–3, an aperture or bore 42 in the cover 28 is typically located directly over the discharge outlet 24 of the well or tap hole in the molten metal vessel 10 when the cover 28 is mounted in a preferred rotational position on the open top end 22 of the molten metal vessel 10.

A plug 44 may be formed of a solid body of refractory material or, preferably, an outer metal frame which surrounds a hollow interior. High temperature blanket insulation fills the hollow interior of the plug 44. A bore 48 extends through the insulation in the interior of the plug 44 for slidably receiving a hanger 50 attached to the slag control shape 32.

According to the present invention, a slag control shape release apparatus 60 is provided for inserting a slag control shape body 32 into the ladle 10 at the appropriate time determined by an operator or ladleman monitoring the metal making process. The release apparatus 60 includes a means for releasably mounting the slag control shape or body 32 on the cover 28, means, mounted on the cover and engageable with the mounting means, for moving the mounting means between first and second positions, and means, separate from the cover and engageable with the moving means, for actuating the moving means to move the mounting means from the first position, the actuating means being operable from a position remote from the cover 28 of the molten metal vessel 10.

As shown in FIG. 1, the conventional casting platform 62 is typically located adjacent to the ladle 10. A tower or frame 64 is mounted in the platform 62 and extends upward therefrom so as to place an upper end of the tower frame 64 generally in the vicinity of the cover 28 on the ladle 10. An arm 66 is connected at a first end 68 to the upper end of the tower frame 64. The arm 66 is preferably pivotally connected to the tower 64 to enable it to be pivoted toward the tower 64 for clearance during movement of the ladle 10. A second end 70 of the arm 66 supports an actuating means of the release apparatus 60 as described hereafter.

Figure 4:
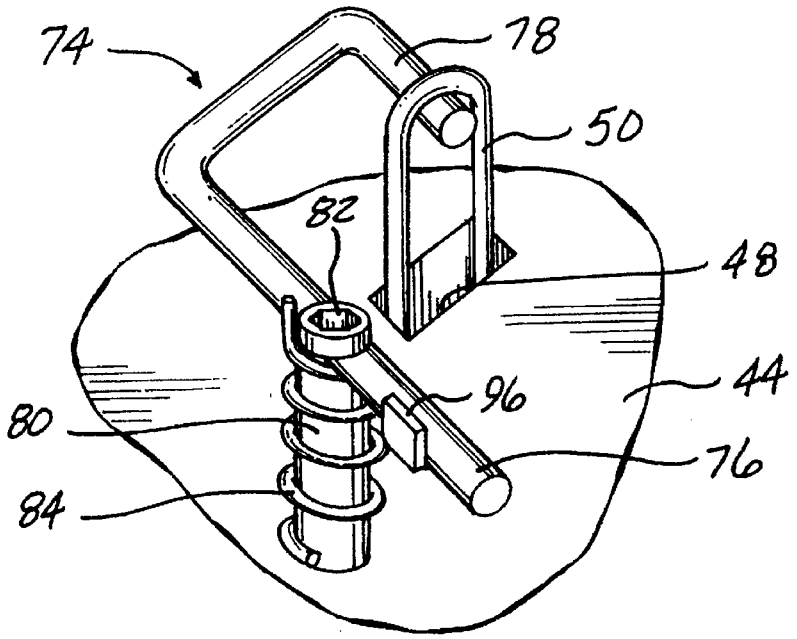
FIG. 4 is a perspective view of the mounting means of the slag control shape release apparatus of the present invention depicted in its slag control shape mounting position.
Figure 5:
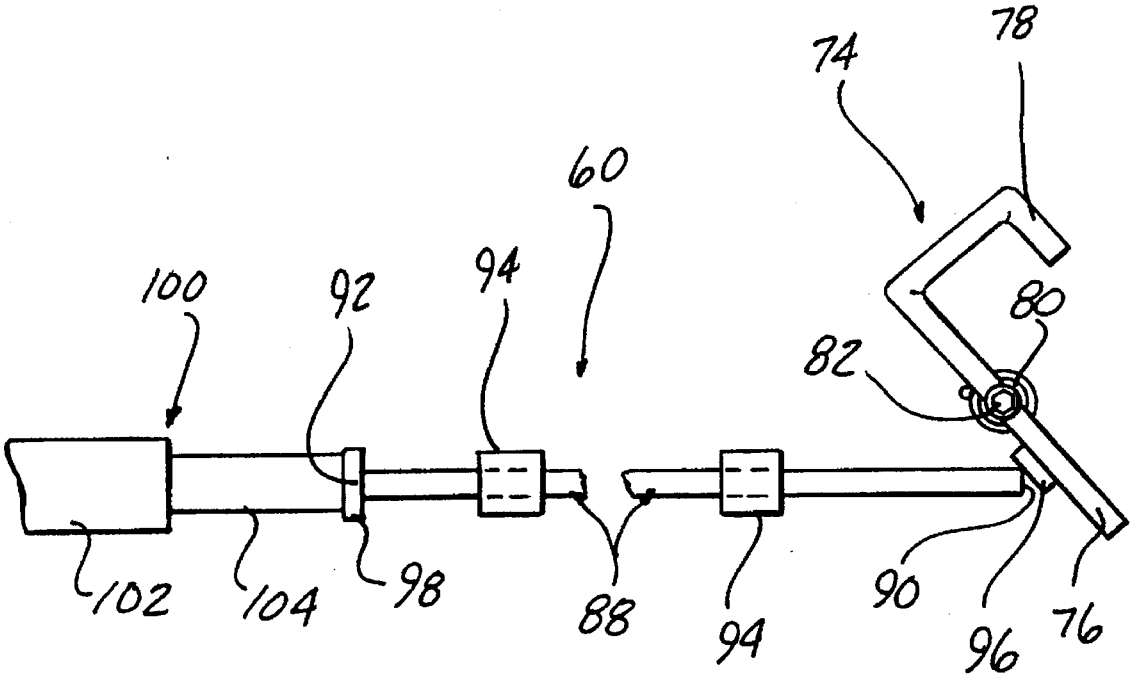
FIG. 5 is a plan view of the slag control shape release apparatus in its actuated slag control shape release position.

The release apparatus 60 includes a mounting means denoted generally by reference number 74 as shown in detail in FIGS. 3, 4, and 5. The mounting means 74 includes a generally J-shaped member having a first end 76 and an opposed second end 78. An intermediate portion of the hook section 74, between the first and second ends 76 and 78 is pivotally mounted to a post 80 fixedly carried on the plug 44. A pin 82 extends through the intermediate portion of the hook member 74 into the post 80 to permit pivotal movement of the hook member 74 with respect to the post 80.

As shown in FIG. 4, the second end 78 of the hook member 74 is normally positioned over the bore 48 in the plug 44 so as to receive the hanger 50 extending from the slag control shape 32 and to support the slag control shape 32 adjacent the inner surface of the cover 28 as shown in FIG. 2.

Biasing means in the form of a coil spring 84 is mounted about the post 80 and engages the hook member 74 to normally bias the hook member 74 to a first position, as shown in FIG. 4, in which hook member 74 is disposed to releasably mount the control shape 32 adjacent the cover 28. The hook member 74 is capable of pivotal movement about the post 80 to a second position, shown in FIG. 5, to release the hanger 50 and the slag control shape 32 from the hook member 74 as described hereafter.

The release apparatus 60 also includes means for moving the mounting means or hook member 74 from the first position shown in FIG. 4 to the second release position shown in FIG. 5. The moving means comprises an elongated push rod 88 having opposed first and second ends 90 and 92, respectively. The push rod 88 extends between an outer edge of the cover 28 to the vicinity of the hook member 74 and is slidably supported by a plurality of spaced guide members all denoted by reference number 94. The guide members 94 may take the form of any suitable bracket or other support, such as a bracket with an open ended groove or a closed bore extending through a body.

A normal position of the push rod 88 is shown in FIGS. 2 and 3. In this position, the first end 90 of the push rod 88 is disposed in close proximity to a push pad 96 mounted on the hook member 94 adjacent to the first end 76 thereof. Alternately, the first end 90 of the push rod 88 may directly engage the hook member 94. A strike plate 98 is mounted on the second end 92 of the push rod 88 for engagement with the actuating means, as described hereafter.

The push rod 88 is freely slidable in the guide members 94 from the normal position shown in FIGS. 2 and 3 to an advanced position shown in FIG. 5 when it is engaged by the actuating means. When the actuating means is deactivated, the biasing spring 84 will pivot the hook member 74 back to the first position shown in FIG. 4 and thereby slide the push rod 88 back to its normal position shown in FIGS. 2 and 3.

The actuating means is denoted generally by reference number 100, as shown in FIGS. 1, 2, 3, and 5. Although the actuating means 100 can take many forms, such as a linear actuator, servo motor, etc., in a preferred embodiment, the actuating means comprises a fluid operated cylinder 102 having an internal piston, not shown, which extensibly and retractably moves a piston rod 104 having one end disposed exteriorly of the cylinder 102. Although air is preferred as the cylinder 102 operating medium, hydraulic oil may also be used.

An operating means, such as a valve 106 connected to a source of pressurized fluid, i.e. pressurized air, hydraulic oil, not shown, is mounted at a convenient location, such as on the tower frame 64. The valve 106 has a fluid line connected to a port on the cylinder 102 on one side of the internal piston. When the valve 106 is activated, pressurized fluid is supplied to one side of the piston in the cylinder 102 to extend the piston rod 104 from a deactivated or disengaged position shown FIGS. 1–3 to an extended position shown in FIG. 5. During such movement, the outer end of the piston rod 104 engages the strike pad 98 to linearly advance the push rod 88. During such linear advance, the first end 90 of the push rod 88 engages the push pad 96 on the hook member 74 to pivot the hook member 74 from the first position shown in FIG. 4 to the slag control shape release position shown in FIG. 5.

After the slag control shape 32 has been released from the hook member 74 and inserted into the ladle 10, the valve 106 is deenergized thereby relieving pressure on one side of the piston. This enables an internal spring, not shown, within the cylinder 102 to retract the piston and piston rod 104 to the disengaged position shown in FIGS. 1–3. As described above, as soon as the piston rod 104 has disengaged from the push rod 88, the biasing spring 80 pivots the hook member 74 back to the first position shown in FIGS. 3 and 4.

The valve 106 may be any suitable fluid control valve, such as a pilot valve, electrical solenoid operated valve, etc. In an exemplary embodiment, the valve 106 is a solenoid valve which is activated by an electrical signal applied from a pushbutton 108 located on the casting platform 62 in a convenient, readily accessible position for the operator or ladleman. An electrical conductor extends from the pushbutton 108 to the valve 106 to activate the valve 106 as long as the pushbutton 108 is depressed. At the completion of discharge of molten metal 12 from the ladle 10, the cover 28 is removed from the ladle 10, such as by a crane, and lowered to the plant floor. The plug 44 is removed from the cover 28 and the hanger 50 of a new slag control shape 32 extended through the bore 38 in the plug 44. To enable the hanger 50 to fully extend through the bore 48, the operator manually pivots the hook member 74 to the second or release position shown in FIG. 5 and then releases the hook member 74 to bring the first end 78 of the hook member 74 into engagement with the hanger 50 to support the new slag control shape 32 on the plug 44. The plug 44 is then inserted back into the cover 28 and the cover 28 is remounted on the open top end 22 of the ladle 10.

As the cover 28 and the open top end 22 of the ladle 10 are typically circular in configuration, the cover 28 may be remounted on the open top end 22 of the ladle 10 in any angular orientation. However, it is conventional for the cover 28 and ladle 10 to have interlocking lugs to insure that the cover 28 is mounted on the ladle 10 in a position such that the slag control shape 32 is located over the discharge outlet 24.

In order to insure proper operation of the release apparatus 60, the release apparatus 60 of the present invention includes alignment means for determining alignment of the piston rod 104 and the push rod 88. The alignment means may take the form, by example only, of a light emitter 110 and light reflector 112 which are respectively mounted on the arm 66 and the cover 28 as shown in FIGS. 1–3. The light emitter 110, when activated by the application of electrical power, such as by a signal from a pushbutton, not shown, located on casting platform 62, projects a light beam toward the light reflector 112. When the cover 28 is properly oriented on the ladle 10 so as to co-linearly align the piston rod 104 and the push rod 88, the light beam is reflected from the light reflector 102 back to the light emitter 110 and strikes a photodetector in the light emitter 110. This generates a signal which may be connected to a suitable indicator means, such as a light 114, etc., to provide an indication of proper alignment of the piston rod 104 and the push rod 88. The cover 28 may be rotated on the ladle 10, as necessary, to bring the push rod 88 into alignment with the piston rod 104.

The alignment means may take other forms which function to insure that the piston rod 104 is aligned with the push pad 96 on the hook member 94 so that the piston rod 104 strikes the push pad 96 when the piston rod 104 is extended. For example, a television monitor may be used to provide a visual picture of the position of the push pad 96 relative to the piston rod 104 when the cover 28 is remounted on the ladle 10.

In use, with the release apparatus 60 in its normal position shown in FIG. 1, when the operator determines that it is the appropriate time to insert the slag control shape 32 into the ladle, the operator depresses the pushbutton 108 to activate the valve 106. This applies pressurized fluid to the cylinder 102 and causes the piston rod 104 to extend into engagement with the strike plate 98 on the push rod 88. The extension of the piston rod 104 also causes linear advance of the push rod 88 which results in pivotal movement of the hook member 74 from the first slag control shape mounting position shown in FIGS. 2–4 to the second release position shown in FIG. 5. As soon as the second end 78 of the hook member 74 disengages from the hanger 50 of the slag control shape 32, the slag control shape 32 is free to descend into the ladle 10.

In summary, there has been disclosed a unique slag control shape release apparatus which is convenient to operate from a position readily accessible to a metal working operator. The release apparatus is formed of a minimum number of components for a low cost and long term reliable use.

What is claimed is:

1. A slag control shape release apparatus for a molten metal receptacle having a top cover and a bore formed in and extending through the cover, the apparatus comprising:

means, mountable on the cover, for releasably mounting a slag control shape on the cover, the mounting means movable between a first position releasably mounting a slag control shape on the cover and a second position releasing the slag control shape for descent into the molten metal receptacle, the mounting means including a mounting member pivotally mounted on the cover and releasably engagable with a slag control shape mounted through the bore in the cover;

means, mounted on the cover and engagable with the mounting means, for moving the mounting means from the first position to the second position; and means, separate from the with the moving means, for actuating the moving means to move the mounting means from the first position, the actuating means being operable from a position remote from the cover.

2. The slag control shape release apparatus of claim 1 wherein the mounting means comprises:

a hook member having first and second ends, the hook member pivotally mounted to the cover intermediate the first and second end.

3. The slag control shape release apparatus of claim 1 further comprising:

means for normally biasing the mounting member to the first position.

4. The slag control shape release apparatus of claim 3 wherein the biasing means comprises a spring coupled to the mounting member.

5. The slag control shape release apparatus of claim 1 wherein the moving means comprises: a rod movably mounted on the cover and having first and second opposed ends, the first end engageable with the mounting means, the second end engageable by the actuating means.

6. The slag control shape release apparatus of claim 5 further comprising: support means carried on the cover, for movably supporting the rod.

7. The slag control shape release apparatus of claim 1 where in the actuating means comprises:

a fluid operable cylinder having an extensible and retractable piston rod with an end extending exteriorly of the cylinder, the end of the piston rod engageable with the moving means when the piston rod is extended;

valve means for selectively supplying pressurized fluid to the cylinder to extend the piston rod; and means, remote from the cylinder, for operating the valve means to supply pressurized fluid to the cylinder.

8. A slag control shape release apparatus for a molten metal receptacle having a top cover and a bore formed in and extending through the cover, the apparatus comprising:

means, mountable on the cover, for releasably mounting a slag control shape on the cover, the mounting means movable between a first position releasably mounting a slag control shape on the cover and a second position releasing the slag control shape for descent into the molten metal receptacle;

means, mounted on the cover and engagable with the mounting means, for moving the mounting means from the first position to the second position;

means, separate from the cover and engagable with the moving means, for actuating the moving means to move the mounting means from the first position, the actuating position being operable from a position remote from the cover; and means for determining alignment of the actuating means and the moving means when the cover is disposed on the molten metal receptacle, the alignment determining means generating an output indicating alignment between the actuating means and the moving means.

9. A slag control shape release apparatus for a molten metal receptacle having a top cover and a bore formed in and extending through the cover, the apparatus comprising:

means, mountable on the cover, for releasably mounting a slag control shape on the cover, the mounting means movable between a first position releasably mounting a slag control shape on the cover and a second position releasing the slag control shape for descent into the molten metal receptacle;

means, mounted on the cover and engagable with the mounting means, for moving the mounting means from the first position to the second position;

means, separate from the cover and engagable with the moving means, for actuating the moving means to move the mounting means from the first position, the actuating position being operable from a position remote from the cover; and means for determining alignment of the actuating means and the moving means when the cover is disposed on the molten metal receptacle, the alignment determining means generating an output indicating alignment between the actuating means and the moving means; the alignment determining means including:

a light emitter mounted on one of the actuating means and the cover; and a light reflector mounted on the other of the actuating means and the cover.

10. The slag control shape release apparatus of claim 1 wherein the moving means includes:

a rod movably mounted on the cover and having first and second opposed ends, the first end engagable with the mounting member, the second end engagable by the actuating means;

the actuating means including:

a fluid operable cylinder having an extensible and retractable piston rod with an end extending exteriorly of the cylinder, the end of the piston rod engagable with the mounting means when the piston rod is extended;

valve means for selectively supplying pressurized fluid to the cylinder to extend the piston rod; and means, remote from the cylinder, for operating the valve means to supply pressurized fluid to the cylinder.

11. The slag control shape release apparatus of claim 10 further comprising:

means for determining alignment of the actuating means and the moving means when the cover is disposed on the molten metal receptacle, the alignment determining means generating an output indicating alignment between the actuating means and the moving means.

12. A slag control shape release apparatus for a molten metal receptacle having a top cover and a bore formed in and extending through the cover, the apparatus comprising:

means, mountable on the cover, for releasably mounting a slag control shape on the cover, the mounting means movable between a first position releasably mounting a slag control shape on the cover and a second position releasing the slag control shape for descent into the molten metal receptacle;

means, mounted on the cover and engagable with the mounting means, for moving the mounting means from the first position to the second position; and means, separate from the cover and engagable with the moving means, for actuating the moving means to move the mounting means from the first position, the actuating position being operable from a position remote from the cover, the actuating means operable to advance from a first position disengaged from the moving means to a second position engaged with the moving means to advance the moving means into moving engagement with the mounting means.

* * * * *